US012721488B2

(12) United States Patent
Hiroyuki et al.

(10) Patent No.: US 12,721,488 B2
(45) Date of Patent: Sep. 1, 2026

(54) DUST COLLECTING DEVICE AND AN ELECTRIC VACUUM CLEANER WITH IT

(71) Applicant: Nippon Seal (H.K.) Co., Ltd., Hong Kong (HK)

(72) Inventors: Uratani Hiroyuki, Hong Kong (HK); Sui Lun Cheung, Hong Kong (HK)

(73) Assignee: Nippon Seal (H.K.) Co., Ltd., Hong Kong (HK)

( * ) Notice: Subject to any disclaimer, the term of this patent is extended or adjusted under 35 U.S.C. 154(b) by 377 days.

(21) Appl. No.: 18/386,645

(22) Filed: Nov. 3, 2023

(65) Prior Publication Data

US 2024/0057830 A1 Feb. 22, 2024

Related U.S. Application Data

(63) Continuation of application No. PCT/CN2021/141638, filed on Dec. 27, 2021.

(51) Int. Cl.
*A47L 9/10* (2006.01)
*A47L 9/04* (2006.01)

(52) U.S. Cl.
CPC ..... *A47L 9/106* (2013.01); *A47L 9/0411* (2013.01); *A47L 9/0477* (2013.01); *A47L 9/0433* (2013.01)

(58) Field of Classification Search
CPC ..... A47L 9/106; A47L 9/0411; A47L 9/0477; A47L 9/0433; A47L 9/0427
See application file for complete search history.

(56) References Cited

U.S. PATENT DOCUMENTS

2003/0163888 A1* 9/2003 Joo ..... A47L 9/0494 15/388
2006/0236491 A1* 10/2006 Baek ..... A47L 9/0488 15/345
2007/0192979 A1 8/2007 Knopow et al.

FOREIGN PATENT DOCUMENTS

| | | | |
|---|---|---|---|
| GB | 2350782 | A | 12/2000 |
| JP | H0722565 | B2 | 3/1995 |
| JP | 3439459 | B2 | 8/2003 |
| WO | 2012094106 | A1 | 7/2012 |

OTHER PUBLICATIONS

International Search Report of PCT Patent Application No. PCT/CN2021/141638 issued on Sep. 27, 2022.

* cited by examiner

*Primary Examiner* — Andrew A Horton

(57) ABSTRACT

A dust collecting device and an electric vacuum cleaner with it are provided. The dust collecting device comprises a main body with an opening, a first dust collector with a first dust collecting brush for collecting dust, and a second dust collector with a second dust collecting brush for collecting dust; the first dust collector and the second dust collector are rotatably held in parallel inside the main body; when the first dust collecting brush is at the opening, the first dust collecting brush is inclined toward the second dust collector; when the second dust collecting brush is at the opening, the second dust collecting brush is inclined toward the first dust collector.

6 Claims, 2 Drawing Sheets

DUST COLLECTING DEVICE AND AN ELECTRIC VACUUM CLEANER WITH IT

CROSS REFERENCE TO RELATED APPLICATIONS

The present application is a Continuation Application of PCT Application No. PCT/CN2021/141638 filed on Dec. 27, 2021, the contents of which are incorporated herein by reference in their entirety.

FIELD OF THE INVENTION

The present application relates to the field of household cleaning, in particular to a dust collecting device with a duo rolls self cleaning brush and an electric vacuum cleaner with it.

BACKGROUND OF THE INVENTION

Japanese Patent (No. 3439459) discloses a brush, in which the dust collector has a substantially semi-conical shape and a second dust collector 30rush is installed on the outer peripheral surface symmetrically with respect to the circumferential center line. Then, the storage brushes are provided on both sides of the outer peripheral surface of the dust collector so as to face the dust collection brush provided on the dust collector; the dust collector is pivot so that it is located at the end of the pivot region and is located on the side to be cleaned. When using it, the dust collector is pivot and moved to the opposite end of the pivot range to move the dust into the main body of the dust collector, and when the dust collector is reversed and pivoted, it is collected and adhered to the dust collecting brush. The dust collecting brush is cleaned by collecting the dust collected by the storage brush. The dust collected by the storage brush is collected at the end of the dust collecting brush on the side of the main body of the dust collecting part by further reversing and pivoting the dust collecting body, and moves to the inside of the main body of the dust collecting part. By repeating this operation, dust is accumulated inside the dust collector. However, in order to perform the reciprocating operation of the dust collector in the cleaning work, it is necessary to manually rotate the dust collector. In addition, a pair of dust collecting brushes and a storage brush is required for the forward and backward movements, respectively, and a total of two pairs of four brushes are required.

Further, Japanese Patent (No. 2015932) discloses an electric vacuum cleaner, in which two dust collectors are arranged in parallel in a semi-conical shape. The two dust collectors are not connected, and each can operate the target pivot range individually. The pivot of the dust collector operates by the frictional resistance generated between the surface to be cleaned and the dust collecting first dust collecting brush arranged on the outer peripheral surface of the dust collector. However, if the main body of the dust collector inside the dust collector is tilted and the frictional resistance from the surface to be cleaned is not evenly applied to the two dust collectors, the two dust collectors pivot relative to each other. Cannot be stored in the main body of the electric vacuum cleaner because the dust cannot be normally moved into the main body of the dust collector. Further, since the dust collector has a semi-conical shape, the area that closes the dust suction port changes due to rotation. When the suction force of the main body of the vacuum cleaner is applied, a negative pressure is generated inside the main body of the dust collector, and this negative pressure causes the dust collector to pivot due to the wind pressure flowing in from the dust suction port, and the angle at which the dust suction port is closed. Is held in. Therefore, the pivot operation of the dust collector is not stable, and dust collection efficiency decreases.

SUMMARY OF THE INVENTION

The technical problem to be solved by the application is to provide a dust collecting device that can collect dust even when the power of the electric vacuum cleaner is turned off and can be used at any time without worrying about noise.

In order to solve the above technical problems, the technical scheme adopted by the application is to provide a dust collecting device; the dust collecting device comprises a main body with an opening, a first dust collector with a first dust collecting brush for collecting dust, and a second dust collector with a second dust collecting brush for collecting dust; the first dust collector and the second dust collector are rotatably held in parallel inside the main body; the opening is arranged at outer peripheral surface of the main body; the first dust collecting brush is arranged at outer peripheral surface of the first dust collector; the second dust collecting brush is arranged at outer peripheral surface of the second dust collector; one part of the first dust collector is arranged at the opening so as to exposed from the main body; one part of the second dust collector is arranged at the opening so as to exposed from the main body; the first dust collecting brush and the second dust collecting brush are alternately moved in and out from the opening; when the first dust collecting brush is at the opening, the first dust collecting brush is inclined toward the second dust collector; when the second dust collecting brush is at the opening, the second dust collecting brush is inclined toward the first dust collector.

In the dust collecting device provided by the present application, the first dust collector and the second dust collector both have a cylindrical shape.

By adopting the dust collecting device of the above technical scheme, two substantially cylindrical dust collectors are rotatably arranged in parallel inside the main body, a part of which is arranged at a position exposed from the main body. Further, the two substantially cylindrical dust collectors are provided on a part of the outer peripheral surface of the main body by providing dust collector brushes for dust collection. Since the body pivots according to the surface to be cleaned due to the frictional resistance of the surface to be cleaned, it is possible to provide a simple cleaning tool that can automatically change to an appropriate cleaning state without the need to operate the switching lever.

In the dust collecting device provided by the present application, the first dust collector and the second dust collector are configured to pivot in conjunction with each other in the same direction. In this embodiment, the dust collectors are connected inside the main body and are configured to rotate in conjunction with each other in the same direction. If a part of one dust collector is in contact with the surface to be cleaned, it is possible to provide a high-performance cleaning tool that can pivot the two connected dust collectors and surely change to an appropriate cleaning state.

In the dust collecting device provided by the present application, the first dust collector further comprises a first rotation assisting member arranged at the outer peripheral surface of the first dust collector, the second dust collector further comprises a second rotation assisting member arranged at the outer peripheral surface of the second dust collector, and the first rotation assisting member and the second rotation assisting member have an appropriate frictional resistance. In this embodiment, even on a slippery surface to be cleaned by having a rotation assisting member having an appropriate frictional resistance in a portion of the outer peripheral surface of the dust collector that does not have a dust collecting brush, it is possible to provide a high-performance cleaning tool that can surely change to an appropriate cleaning state.

In the dust collecting device provided by the present application, the dust collecting device further comprises a stopper arranged in the main body, and the stopper is configured to lock the rotation of the first dust collector and the second dust collector.

In the dust collecting device provided by the present application, the first dust collector further comprises a first pivoting shaft with a first gear provided at the end; the second dust collector further comprises a second pivoting shaft with a second gear provided at the end; the first gear and the second gear are connected by a third gear; the first gear and the second gear are provided with a locking portion that regulates a pivot range and are in contact with the stopper to regulate a rotation range.

In the dust collecting device provided by the present application, the main body has a connecting portion to which an electric vacuum cleaner can be connected. In this embodiment, by having a connecting portion capable of connecting the electric vacuum cleaner to the main body of the dust collecting device, the dust stored inside the main body of the cleaning body is collected by the suction force of the electric vacuum cleaner in the main body of the electric vacuum cleaner. It can be transferred to the dust collector, and the dust storage volume inside the second dust collector 30ody can be set small, which makes it possible to reduce the size and weight.

The following beneficial effects can be achieved by the present application:

1. It is not necessary to manually rotate the dust collector, and the dust collector can be automatically pivoted to the optimum position in conjunction with the reciprocating operation of the main body of the dust collecting device.
2. Further, since one dust collecting brush is provided for each dust collector, it can be configured with two brushes, which is half of the conventional example.
3. Moreover, since the pivot of the dust collector is connected and operates in conjunction with the conventional example two, the two dust collectors can surely pivot in the same direction even when the main body of the dust collecting device is tilted, and stable dust is produced.
4. In addition, since the dust collector has a cylindrical shape, the opening area of the dust suction port does not change depending on the angle at which the dust collector is located, so that uniform suction pressure continues, and the suction pressure affects the movement of the dust collector. It is possible to reliably perform the pivoting operation at the time of cleaning.

BRIEF DESCRIPTION OF THE DRAWINGS

In order to more clearly explain the technical scheme in the embodiment of the application, the attached drawings needed to be used in the description of the embodiment will be briefly introduced. Obviously, the drawings described below are only some embodiments of the application. For ordinary technicians in the art, without paying creative labor, other drawings may also be obtained from these drawings.

DETAILED DESCRIPTION OF THE PREFERRED EMBODIMENT

In order to facilitate the understanding of the invention, the invention will be described more comprehensively below with reference to the relevant drawings. Typical embodiments of the invention are given in the accompanying drawings. However, the invention can be implemented in many different forms and is not limited to the embodiments described herein. On the contrary, the purpose of providing these embodiments is to make the disclosure of the invention more thorough and comprehensive.

Unless otherwise defined, all technical and scientific terms used herein have the same meanings as those commonly understood by those skilled in the technical field of the invention. The terms used in the description of the invention herein are only for the purpose of describing specific embodiments and are not intended to limit the invention.

Figure 1:
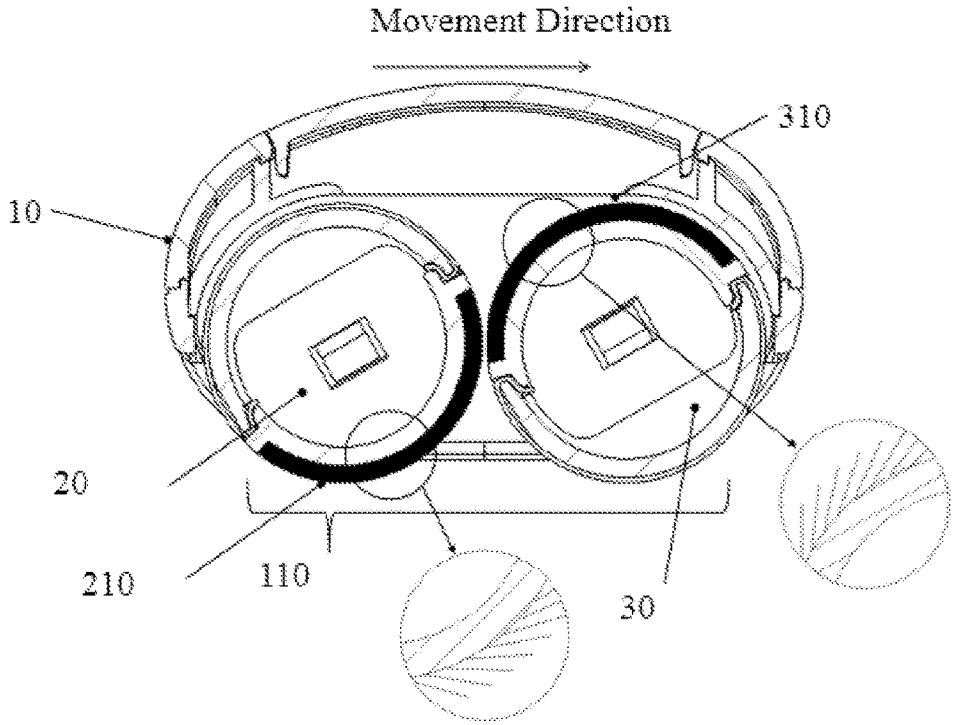
FIG. 1 is a structural diagram of the dust collecting device provided by the embodiment of the present application when the first dust collector is located at a position exposed from the main body.
Figure 2:
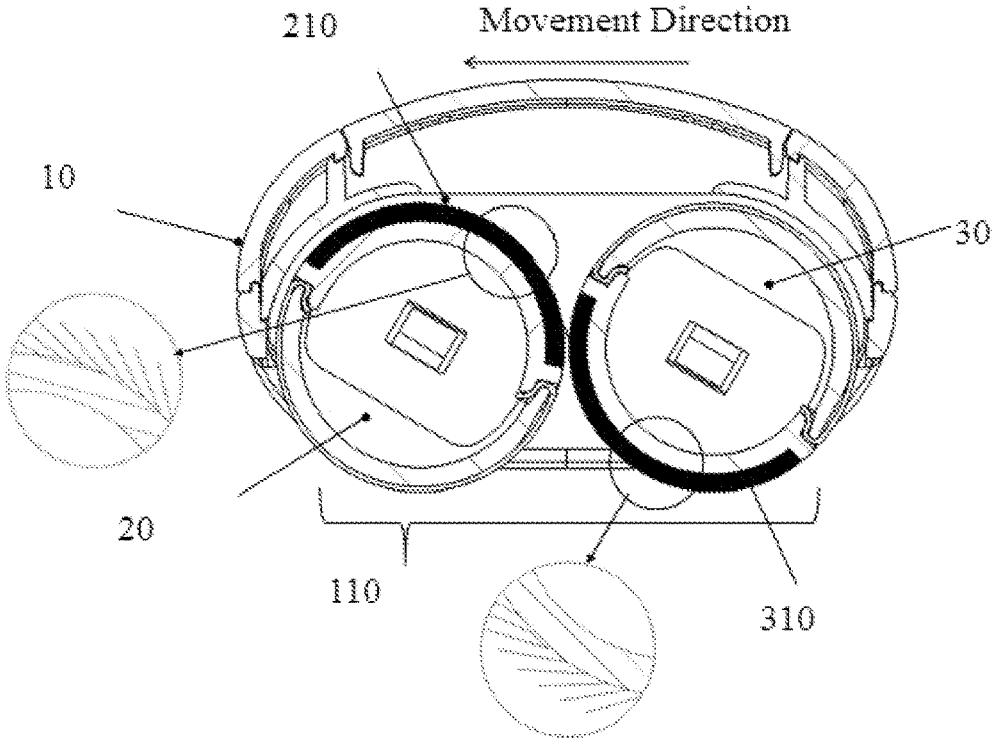
FIG. 2 is a structural diagram of the dust collecting device provided by the embodiment of the present application when the second dust collector is located at a position exposed from the main body.

This embodiment provides a dust collecting device. Referring to FIG. 1 and FIG. 2, which provides structural diagrams of the dust collecting device provided by the embodiment of the present application. As shown in FIG. 1, the dust collecting device comprises a main body 10 with an opening 110, a first dust collector 20 with a first dust collecting brush 210 for collecting dust, and a second dust collector 30 with a second dust collecting brush 310 for collecting dust. The first dust collector 20 and the second dust collector 30 both have a cylindrical shape. As can be seen from FIG. 1, the first dust collector 20 and the second dust collector 30 are rotatably held in parallel inside the main body 10; the opening 110 is arranged at outer peripheral surface of the main body 10. Further, the first dust collecting brush 210 is arranged at outer peripheral surface of the first dust collector 20, and the second dust collecting brush 310 is arranged at outer peripheral surface of the second dust collector 30; one part of the first dust collector 20 is arranged at the opening 110 so as to exposed from the main body 10; one part of the second dust collector 30 is arranged at the opening 110 so as to exposed from the main body 10; the first dust collecting brush 210 and the second dust collecting brush 310 are alternately moved in and out from the opening 110. As can be seen from FIG. 1, when the first dust collecting brush 210 is at the opening 110, the first dust collecting brush 210 is inclined toward the second dust collector 30. As can be seen from FIG. 2, when the second dust collecting brush 310 is at the opening 110, the second dust collecting brush 310 is inclined toward the first dust collector 20.

By adopting the dust collecting device of the embodiment, two substantially cylindrical dust collectors are rotatably arranged in parallel inside the main body, a part of which is arranged at a position exposed from the main body. Further, the two substantially cylindrical dust collectors are provided on a part of the outer peripheral surface of the main body by providing dust collector brushes for dust collection. Since the body pivots according to the surface to be cleaned due to the frictional resistance of the surface to be cleaned, it is possible to provide a simple cleaning tool that can automatically change to an appropriate cleaning state without the need to operate the switching lever.

In addition, the first dust collector 210 and the second dust collector 310 are configured to pivot in conjunction with each other in the same direction. In this embodiment, the dust collectors are connected inside the main body and are configured to rotate in conjunction with each other in the same direction. If a part of one dust collector is in contact with the surface to be cleaned, it is possible to provide a high-performance cleaning tool that can pivot the two connected dust collectors and surely change to an appropriate cleaning state.

Further, the dust collecting device further comprises a stopper (50) arranged in the main body 10, and the stopper is configured to lock the rotation of the first dust collector 20 and the second dust collector 30.

Figure 3:
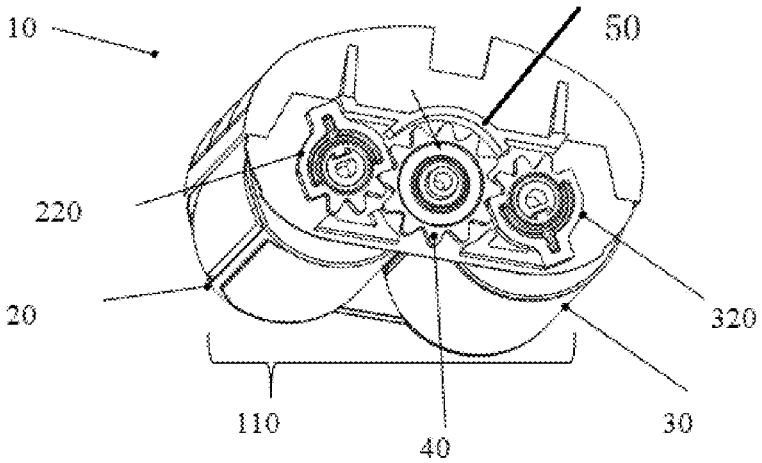
FIG. 3 is a structural diagram of the dust collecting device seen from another side.

Further, as shown in FIG. 3, the first dust collector 20 further comprises a first pivoting shaft with a first gear 220 provided at the end; the second dust collector 30 further comprises a second pivoting shaft with a second gear 320 provided at the end; the first gear 220 and the second gear 320 are connected by a third gear 40; the first gear 220 and the second gear 320 are provided with a locking portion that regulates a pivot range and are in contact with the stopper to regulate a rotation range.

Further, the main body 10 has a connecting portion (not shown in the figure) to which an electric vacuum cleaner can be connected. In this way, the dust stored in the main body 10 moves to the dust collecting part of the main body of the electric vacuum cleaner by the suction wind of the electric vacuum cleaner, so that the dust collecting part can be miniaturized and a large amount of dust can be collected from the surface to be cleaned. In this embodiment, by having a connecting portion capable of connecting the electric vacuum cleaner to the main body of the dust collecting device, the dust stored inside the main body of the cleaning body is collected by the suction force of the electric vacuum cleaner in the main body of the electric vacuum cleaner. It can be transferred to the dust collector, and the dust storage volume inside the second dust collector 30 can be set small, which makes it possible to reduce the size and weight.

Figure 4:
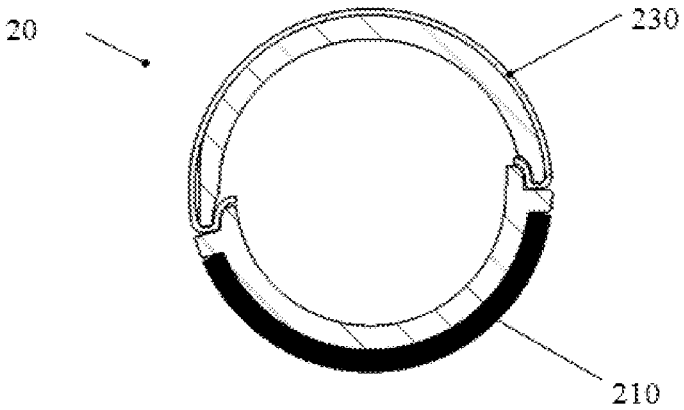
FIG. 4 is a structural diagram of dust collector provided by the first embodiment of the present application.

Moreover, as shown in FIG. 4, the outer peripheral surface of each dust collector has a rotation assisting member having an appropriate frictional resistance at a portion that does not have a dust collecting brush. In this way, even when one dust collector floats from the surface to be cleaned, the dust collector can be reliably rotated as long as the rotation assisting member of the other dust collector is in contact with the surface to be cleaned. Therefore, the first dust collector 20 further comprises a first rotation assisting member 230 arranged at the outer peripheral surface of the first dust collector, the second dust collector 30 further comprises a second rotation assisting member arranged at the outer peripheral surface of the second dust collector, and the first rotation assisting member and the second rotation assisting member have an appropriate frictional resistance. In this embodiment, even on a slippery surface to be cleaned by having a rotation assisting member having an appropriate frictional resistance in a portion of the outer peripheral surface of the dust collector that does not have a dust collecting brush, it is possible to provide a high-performance cleaning tool that can surely change to an appropriate cleaning state.

Now explaining the operation of the dust collecting device:

As shown in FIG. 1, when the first dust collecting brush 210 of the first dust collector 20 is exposed from the opening 110 of the main body 10, the second dust collecting brush 310 of the second dust collector 30 is located inside the main body 10.

This is because the cylindrical first dust collector 20 and the second dust collector 30 move in contact with each other on the surface to be cleaned, and the first dust collector 20 and the second dust collector 30 pivot in the same direction due to the frictional force with the surface to be cleaned. In the state shown in FIG. 1, it is locked by a stopper provided inside the main body 10.

After that, when the moving direction of the main body is opposite, the first dust collecting brush 210 of the first dust collector 20 pivot toward the inside of the main body 10 as shown in FIG. 2. The second dust collecting brush 310 pivot toward the opening.

The rotation of each dust collector is stopped by a stopper provided inside the main body at a position where the dust collector is pivoted by a certain angle.

Each time the moving direction of the main body is reversed, the first dust collector 20 and the second dust collector 30 pivot in the same direction, and the first dust collecting brush 210 and the second dust collecting brush 310 are alternately moved in and out from the opening.

Then, when the moving direction of the main body is reversed, the first dust collector 20 pivot in the main body while keeping the dust collected from the surface to be cleaned attached to the first dust collecting brush 210, and collects the dust in the main body. Transfer to the inside.

At the same time, the second dust collecting brush 310 located inside the main body of the dust collector is exposed from the opening and comes into contact with the surface to be cleaned to collect dust from the surface to be cleaned.

When the moving direction of the main body is reversed again, each dust collector pivot in a direction opposite to the rotation direction.

At this time, the first dust collecting brush 210 of the first dust collector 20 located inside the main body of the dust collector pivot toward the opening of the main body with dust attached, but the second dust collecting brush 310 moves to the inside of the main body with the dust collected from the surface to be cleaned adhered.

Since the brush tips of the first dust collecting brush 210 and the second dust collecting brush 310 are configured so that a part of them come into contact with each other, the dust adhering to the first dust collecting brush 210 is caught by the tip of the second dust collecting brush 310 and adheres to the second dust collecting brush 310.

Therefore, the first dust collecting brush 210 comes into contact with the surface to be cleaned in a clean state after the dust is removed by the second dust collecting brush 310, and new dust is collected from the surface to be cleaned.

As shown above, each brush collects dust from the surface to be cleaned and transfers it to the inside of the dust collector every time the operating direction of the main body changes, and the operating direction of the main body changes again. When the dust is inverted, the dust transferred to the inside of the dust collector is removed by the opposing brush, and the dust is accumulated inside while rotating to the opening.

By repeating this operation, the dust on the surface to be cleaned is transferred and accumulated inside the main body.

The above illustration describes the implementation of inventions, but inventions are not limited to the above specific implementation methods. The above specific implementation methods are only schematic rather than restrictive. Under the inspiration of inventions, ordinary technicians in this field can also make many forms without breaking away from the scope protected by invention purposes and rights requirements, which are within the protection of inventions.

What is claimed is:

1. A dust collecting device, wherein, the dust collecting device comprises a main body with an opening, a first dust collector with a first dust collecting brush for collecting dust, and a second dust collector with a second dust collecting brush for collecting dust; the first dust collector and the second dust collector are rotatably held in parallel inside the main body; the opening is arranged at outer peripheral surface of the main body; the first dust collecting brush is arranged at outer peripheral surface of the first dust collector; the second dust collecting brush is arranged at outer peripheral surface of the second dust collector; one part of the first dust collector is arranged at the opening so as to exposed from the main body; one part of the second dust collector is arranged at the opening so as to exposed from the main body; the first dust collecting brush and the second dust collecting brush are alternately moved in and out from the opening; when the first dust collecting brush is at the opening, the first dust collecting brush is inclined toward the second dust collector; when the second dust collecting brush is at the opening, the second dust collecting brush is inclined toward the first dust collector;

the cylindrical first dust collector and the second dust collector move in contact with each other on a surface to be cleaned, and the first dust collector and the second dust collector pivot in the same direction due to a frictional force with the surface to be cleaned;

the first dust collector further comprises a first pivoting shaft with a first gear provided at the end; the second dust collector further comprises a second pivoting shaft with a second gear provided at the end; the first gear and the second gear are connected by a third gear;

a brush tip of the first dust collecting brush and a brush tip of the second dust collecting brush are configured so that a part of the brush tip of the first dust collecting brush and a part of the brush tip of the second dust collecting brush come into contact with each other.

2. The dust collecting device according to claim 1, wherein, the first dust collector and the second dust collector both have a cylindrical shape.

3. The dust collecting device according to claim 1, wherein, the first dust collector further comprises a first rotation assisting member arranged at the outer peripheral surface of the first dust collector, the second dust collector further comprises a second rotation assisting member arranged at the outer peripheral surface of the second dust collector, and the first rotation assisting member and the second rotation assisting member have frictional resistance.

4. The dust collecting device according to claim 1, wherein, the dust collecting device further comprises a stopper arranged in the main body, and the stopper is configured to lock the rotation of the first dust collector and the second dust collector.

5. The dust collecting device according to claim 4, wherein, the first gear and the second gear are provided with a locking portion that regulates a pivot range and are in contact with the stopper to regulate a rotation range.

6. An electric vacuum cleaner, wherein, the electric vacuum cleaner comprises a dust collecting device according to claim 1.

* * * * *